United States Patent [19]

Nakamura

[11] Patent Number: 4,485,279

[45] Date of Patent: Nov. 27, 1984

[54] KEYBOARD SWITCH

[75] Inventor: Moritoshi Nakamura, Miyagi, Japan

[73] Assignee: Alps Electric Co., Ltd., Tokyo, Japan

[21] Appl. No.: 431,386

[22] Filed: Sep. 30, 1982

[30] Foreign Application Priority Data

Feb. 16, 1982 [JP] Japan ..... 57-20562[U]

[51] Int. Cl.[3] ..... H01H 13/70

[52] U.S. Cl. ..... 200/5 A; 200/159 B; 200/306

[58] Field of Search ..... 200/5 A, 8 LR, 159 B, 200/306

[56] References Cited

U.S. PATENT DOCUMENTS 3,898,421 8/1975 Suzumura ..... 200/5 A X
4,046,975 9/1977 Seeger, Jr. ..... 200/5 A
4,249,044 2/1981 Larson ..... 200/306 X
4,365,130 12/1982 Christensen ..... 200/5 A X
4,400,595 8/1983 Ahumada ..... 200/5 A

*Primary Examiner*—J. R. Scott

*Attorney, Agent, or Firm*—Guy W. Shoup; Gerard F. Dunne

[57] ABSTRACT

A keyboard switch includes upper and lower substrates spaced from each other by a spacer having a plurality of spaces in which upper and lower contacts respectively on the upper and lower substrates are placed, respectively. An insulating sheet is sandwiched between the lower substrate and a base plate and has a plurality of slits aligned respectively in vent holes in the base plate and the lower substrate for preventing substantial passage therethrough of dirt or dust while allowing air to flow therethrough.

2 Claims, 6 Drawing Figures

KEYBOARD SWITCH

BACKGROUND OF THE INVENTION

The present invention relates to a keyboard switch, and more particularly to an improvement in an air vent structure for a keyboard switch comprised of a pair of upper and lower flexible insulating films superimposed one over the other with an insulating spacer interposed therebetween.

There is known a keyboard switch comprising a pair of upper and lower insulating films having a spacer interposed therebetween and supporting upper and lower contacts which can be brought into contact with each other when the upper insulating film is depressed by a finger toward the lower insulating film. Air can be vented out of a space between the upper and lower insulating films through vent holes defined in the lower insulating film and a base plate on which the keyboard switch assembly is supported. However, dust or dirt can be drawn into the space through the vent holes and cause malfunctioning of the keyboard switch.

SUMMARY OF THE INVENTION

With the prior problem in view, it is an object of the present invention to provide a keyboard switch having means for preventing entry of dirt or dust into holes in an insulating spacer through vent holes while allowing air to flow into or out of the holes, thereby keeping contacts clean to guard against contact failure.

According to the present invention, an insulating sheet is sandwiched between a lower insulating film and a base plate and has a plurality of slits formed therein and positioned respectively in alignment with vent holes in the lower insulating film and the base plate. The slits serve to allow passage of air therethrough and at the same time to block off entry of dirt or dust therethrough.

The above and other objects, features and advantages of the present invention will become more apparent from the following description when taken in conjunction with the accompanying drawings in which a preferred embodiment of the present invention is shown by way of illustrative example.

DETAILED DESCRIPTION

Figure 1:
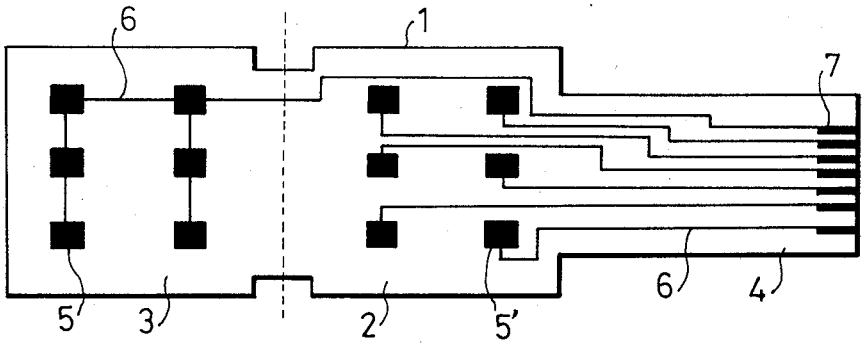
Fig.1 PRIOR ART
FIG. 1 is a plan view of a conventional flexible insulating film as is unfolded, having keyboard switch contacts.
Figure 2:
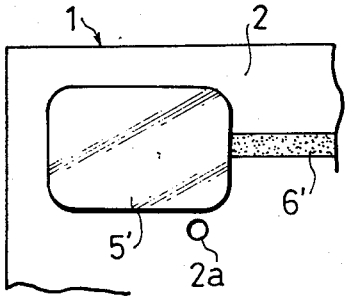
Fig.2 PRIOR ART
FIG. 2 is a fragmentary plan view of a conventional insulating film.
Figure 3:
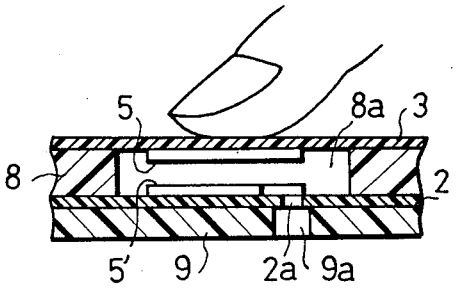
Fig.3 PRIOR ART
FIG. 3 is a fragmentary cross-sectional view of a conventional keyboard switch.

As shown in FIGS. 1 through 3, a conventional keyboard switch comprises a flexible insulating film 1 of synthetic resin on which there are printed contacts 5, 5' of silver or electrically conductive carbon, leads 6, 6' connected to the contacts 5, 5', and terminals 7. The flexible insulating film 1 is folded on itself along a dotted line (FIG. 1) with an insulating spacer 8 sandwiched between upper and lower insulating films 3, 2 so that the contacts 5 on the upper insulating film 3 will confront the contacts 5' on the lower insulating film 2. The folded assembly is bonded by adhesive to a base plate 9 for use as a keyboard switch.

In use, the upper film 3 is depressed by a finger until the upper and lower contacts 5, 5' are brought into mutual contact to turn on the switch. When the finger is lifted, the upper insulating film 3 is caused by the spacer 8 to return to its upper position under its own resiliency, whereupon the switch is turned off.

If air were trapped in a space **8*a* accommodating the upper and lower contacts 5, 5', then it would act as a resistance to downward movement of the upper contact 5 toward the lower contact 5', and as a result the switch could not reliably be turned on and off. To solve such a problem, the insulating film 2 has a circular hole 2*a* and the base plate 9 also has a circular hole 9*a* communicating with the circular hole 2*a*, as shown in FIGS. 2 and 3. When the switch is turned on, air escapes from the space 8*a* through the circular holes 2*a*, 9*a*, and when the switch is turned off, air flows into the space 8*a* through the circular holes 2*a*, 9*a***.

The prior air vent structure is, however, disadvantageous in that foreign matter such as dirt and dust is liable to enter the space **8*a* through the circular holes 2*a*, 9*a* and to get deposited on the contacts 5, 5'**, which may eventually fail to provide good electrical contact.

Figure 4:
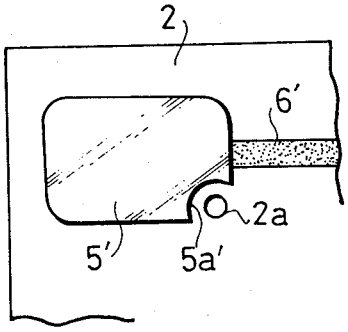
FIG. 4 is a fragmentary plan view of an insulating film according to the present invention.
Figure 5:
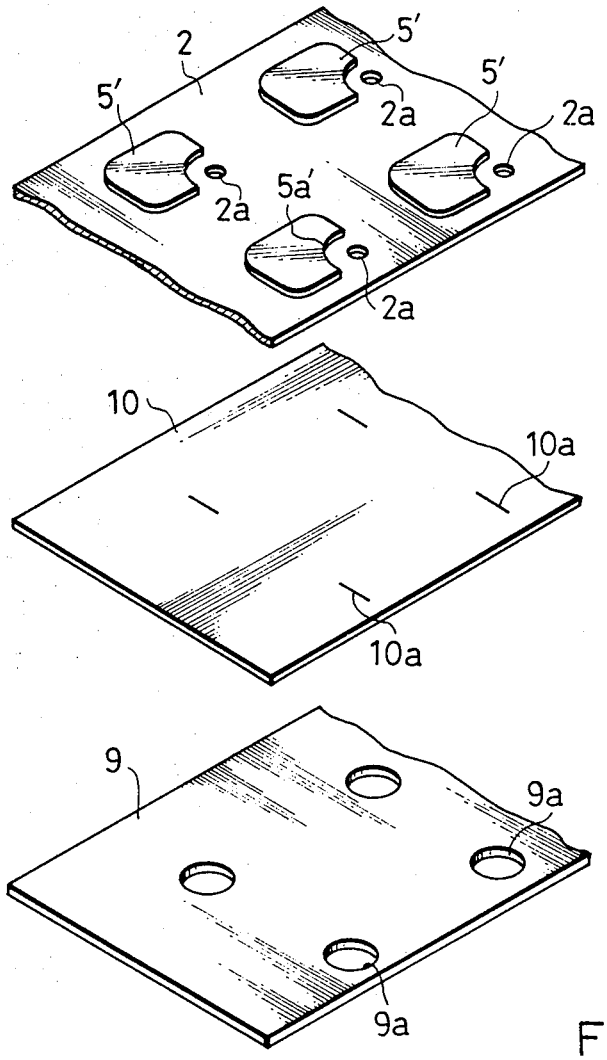
FIG. 5 is an exploded perspective view of a portion of a keyboard switch according to the present invention.
Figure 6:
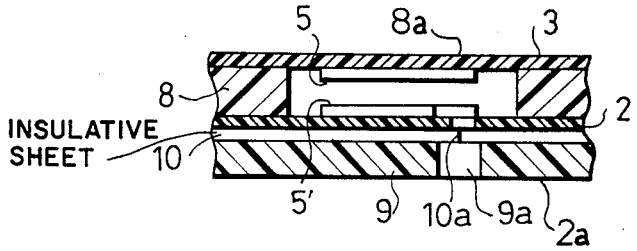
FIG. 6 is a fragmentary cross-sectional view of a keyboard switch constructed in accordance with the present invention.

The present invention will now be described with reference to FIGS. 4 through 6.

A keyboard switch according to the present invention has a lower substrate 2 in the form of an insulating film supporting thereon lower contacts 5' from which leads 6' extend to terminals.

The lower substrate 2 has a plurality of vent holes **2*a* adjacent to lateral edges of the lower contacts 5', respectively. Thus, as many vent holes 2*a* are defined in the lower substrate 2 as there are the contacts 5', as shown in FIG. 5. An upper substrate 3 in the form of an insulating film has thereon a pluality of upper contacts 5. An insulating spacer 8 is interposed between the upper and lower substrates 3, 2 and fixed in position by adhesive. An insulating sheet 10 is placed below the lower substrate 2 and has a plurality of spaced slits 10*a* cut therein by a suitable sharp cutter in alignment with the vent holes 2*a*. A base plate 9 is also placed below the insulating sheet 10 and has as many spaced vent holes 9*a* as the slits 10*a***.

The vent holes **2*a*, the slits 10*a* and the vent holes 9*a* are aligned with each other when the lower substrate 2, the insulating sheet 10 and the base plate 9 are bonded together by adhesive. When the keyboard switch is depressed, air is discharged from a space between the upper and lower substrates 3, 2 through the vent holes 2*a*, the slits 10*a* and the vent holes 9*a***.

Operation of the keyboard switch is as follows:

When the upper substrate 3 is depressed to actuate the keyboard switch, the upper substrate 3 is caused to flex into a space **8*a* until the upper contact 5 is brought into contact with the lower contact 5'. At this time, air is discharged out of the space 8*a* through the vent hole 2*a*, the slit 10*a* and the vent hole 9*a***.

When the upper substrate 3 is released, it returns to an original position under its own resiliency. Any dirt or dust tending to flow with air into the space between the upper and lower substrates through the vent hole 9*a*, the slits 10*a* and the vent hole 2*a* is removed by the slits 10*a* without further going through the slits 10*a*. Thus, the space between the upper and lower substrates is always kept clean, and the upper and lower contacts 5, 5' are free from deposition of dirt or dust and hence contact failures are reduced. As a result, the keyboard switch contacts can be brought into or out of electrical connection properly as desired.

Although a certain preferred embodiment has been shown and described, it should be understood that many changes and modifications may be made therein without departing from the scope of the appended claims.

What is claimed is:

1. A keyboard switch comprising:

(a) a base plate having a plurality of first vent holes;

(b) an insulating sheet mounted on said base plate and a plurality of slits located respectively in alignment with said first vent holes for preventing substantial passage therethrough of dirt or dust while permitting air to flow therethrough;

(c) a first substrate mounted on said insulating sheet and having a plurality of second vent holes respectively in alignment with said first vent holes and said slits, said first substrate supporting a plurality of first contacts;

(d) an insulating spacer mounted on said first substrate and having a plurality of spaces in which said first contacts are positioned, respectively, said first vent holes, said slits and said second vent holes communicating with said spaces; and (e) a second substrate mounted on said insulating spacer and having a plurality of second contacts placed in said spaces respectively in alignment with said first contacts.

2. A keyboard switch according to claim 1, wherein said first contacts have recessed edges, said second vent holes being located adjacent to said recessed edges, respectively.

* * * * *